US007172269B2

(12) United States Patent
Sims

(10) Patent No.: US 7,172,269 B2
(45) Date of Patent: Feb. 6, 2007

(54) RESISTOR SHAPES FOR HEATING DEVICES ON AN INTEGRATED CIRCUIT

(75) Inventor: Tyler Sims, Knoxville, TN (US)

(73) Assignee: Avago Technologies Fiber IP (Singapore) Pte. Ltd., Singapore (SG)

( * ) Notice: Subject to any disclaimer, the term of this patent is extended or adjusted under 35 U.S.C. 154(b) by 196 days.

(21) Appl. No.: 10/712,701

(22) Filed: Nov. 13, 2003

(65) Prior Publication Data

US 2005/0104918 A1 May 19, 2005

(51) Int. Cl.
*B41J 2/05* (2006.01)

(52) U.S. Cl. ..... 347/62

(58) Field of Classification Search ..... 347/62, 347/64; 257/363, 379, 516; 219/216; 392/303, 392/338

See application file for complete search history.

(56) References Cited

U.S. PATENT DOCUMENTS 4,847,630 A * 7/1989 Bhaskar et al. ..... 347/63
5,699,462 A * 12/1997 Fouquet et al. ..... 385/18
6,195,478 B1 2/2001 Fouquet
6,227,640 B1 * 5/2001 Maze et al. ..... 347/15
6,320,994 B1 11/2001 Donald et al.
6,324,316 B1 11/2001 Fouquet et al.
6,422,688 B2 * 7/2002 Giere et al. ..... 347/62
6,487,333 B2 11/2002 Fouquet et al.

* cited by examiner

*Primary Examiner*—Stephen Meier
*Assistant Examiner*—Geoffrey S. Mruk

(57) ABSTRACT

A heating device within an integrated circuit includes a first conductive lead, a second conductive lead and a third conductive lead. A first resistive region is connected between the first conductive lead and the third conductive lead. A second resistive region is connected between the second conductive lead and the third conductive lead. A side formed by the first conductive lead and the first resistive region is parallel to a side formed by the second conductive lead and the second resistive region.

6 Claims, 7 Drawing Sheets

RESISTOR SHAPES FOR HEATING DEVICES ON AN INTEGRATED CIRCUIT

BACKGROUND

The present invention relates to components useful in integrated circuits and pertains particularly to resistor shapes for heating devices on an integrated circuit.

For some applications, heating devices are implemented on integrated circuits. For example, one type of total internal reflection (TIR) switching elements used in an optical cross-connection switch utilizes thermal activation to displace liquid from a gap at the intersection of a first optical waveguide and a second optical waveguide. See for example, U.S. Pat. No. 5,699,462. In this type of TIR, a trench is cut through a waveguide. The trench is filled with an index-matching liquid. A bubble is generated at the cross-point by heating the index matching liquid with a localized heater. The bubble must be removed from the crosspoint to switch the cross-point from the reflecting to the transmitting state and thus change the direction of the output optical signal. Efficient operation of such a TIR element requires effective placement and operation of heating devices within and around the TIR elements. Similarly, heating devices are used in other types of devices, for example, to eject ink from a printer head in an inkjet printer.

SUMMARY OF THE INVENTION

A heating device within an integrated circuit includes a first conductive lead, a second conductive lead and a third conductive lead. A first resistive region is connected between the first conductive lead and the third conductive lead. A second resistive region is connected between the second conductive lead and the third conductive lead. A side formed by the first conductive lead and the first resistive region is parallel to a side formed by the second conductive lead and the second resistive region.

DETAILED DESCRIPTION OF EMBODIMENTS OF THE PRESENT INVENTION

Figure 1:
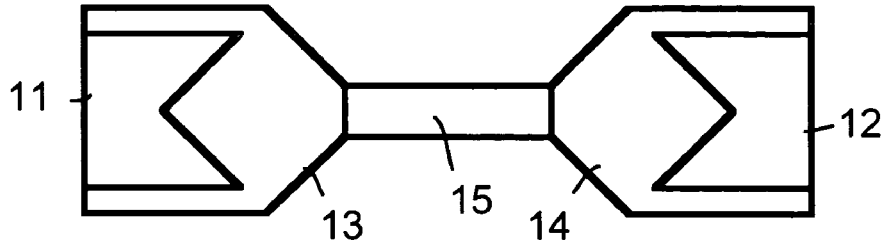
FIG. 1 shows a heating device in accordance with an embodiment of the present invention.

FIG. 1 shows a heater design that allows high energy delivery while lowering heat at a metal/resistor junction. A first layer of resistive material is formed. For example, the first layer of resistive material is tungsten silicon nitrate (e.g., WSi3N4) or some other high resistive material (e.g., TaSi3N4, Si, SiC, TaC, HFC, HfCO, or SiCN). A second layer of resistive material if formed over the first layer of resistive material. The second layer of resistive material has a resistivity lower than the resistivity of the first layer of resistivity. For example, the second layer of resistive material is tantalum aluminum (TaAl) or some other resistive material. A metal layer is formed over the second layer of resistivity. For example, the metal layer is formed of a metal such as aluminum (Al).

The metal layer, first layer of resistive material and the second level of resistive material are etched in a tier shape. This is illustrated by FIG. 1. In FIG. 1, a region 15 of the first layer of resistive material is shown exposed between a region 13 of the second layer of resistive material and a region 14 of the second layer of resistive material. Region 13 of the second layer of resistive material separates region 15 of the first layer of resistive material from a region 11 of the metal layer. Region 14 separates region 15 of the first layer of resistive material from a region 12 of the metal layer.

Region 15 of the first layer of resistive material produces heat, sufficient, for example, to form a bubble in a bubble chamber of a TIR element or to eject an ink droplet from an ink tube. Region 13 of the second layer of resistive material buffers heat from region 15 of the first layer of resistive material so the heat will not damage region 11 of the metal layer. Region 14 of the second layer of resistive material buffers heat from region 15 of the first layer of resistive material so the heat will not damage region 12 of the metal layer.

In one embodiment, region 15 is 6 microns by 40 microns. In alternative embodiments, the size and resistivity of region 15 is varied to meet the requirements of each particular application.

Figure 10:
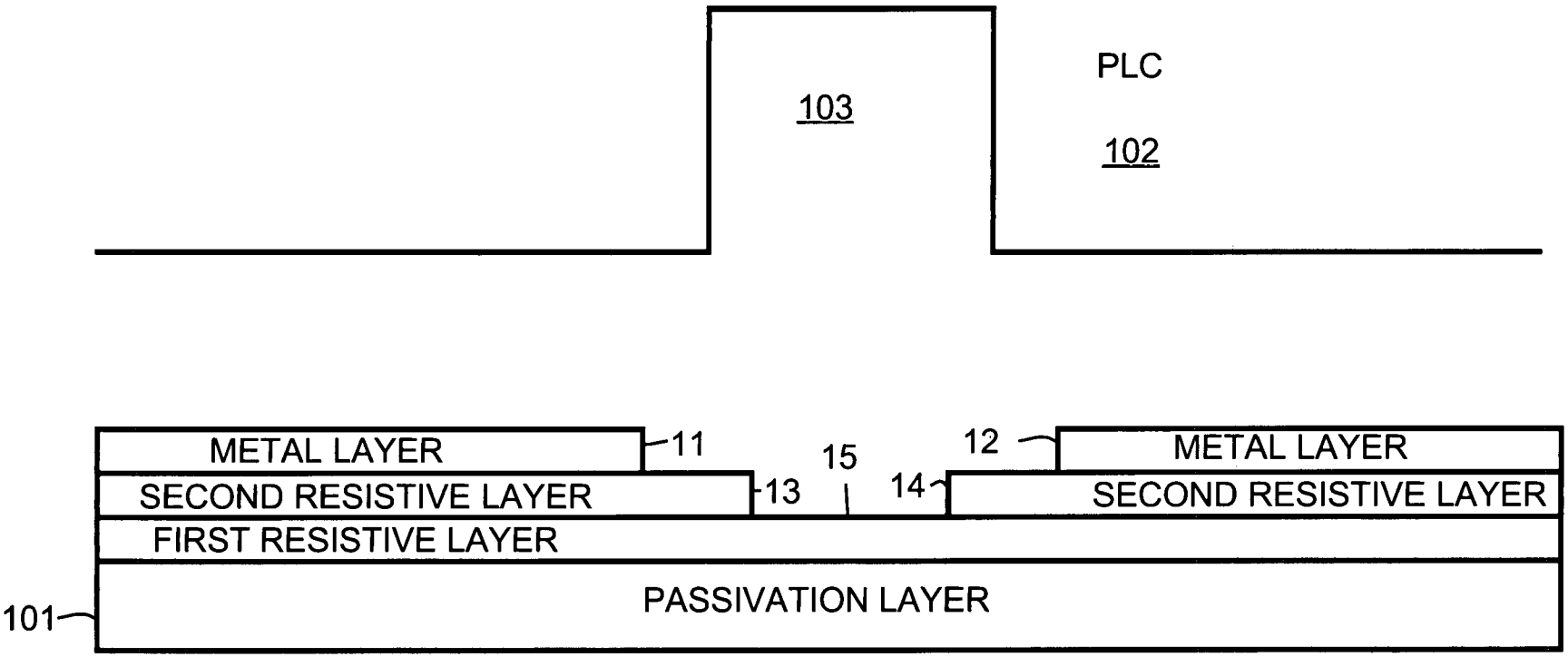
FIG. 10 shows a simplified cross-section of the heating device shown in FIG. 1 in accordance with an embodiment of the present invention.

FIG. 10 shows an example application for the heating device shown in FIG. 1. FIG. 10 shows the first resistor layer, including region 15, formed on a passivation layer 101. The second resistive layer, including region 13 and region 14, is shown formed on the first resistive layer. The metal layer, including region 11 and region 12, are shown formed on the second resistive layer. Region 15 is used to heat fluid in trench 103 for bubble formation in trench 18. Trench 18 intersects a waveguide within a planar light circuit (PLC) 102. Alternatively, in a different application, region 15 can be used to heat droplets of ink ejected from an inkjet tube within an inkjet printhead.

Figure 2:
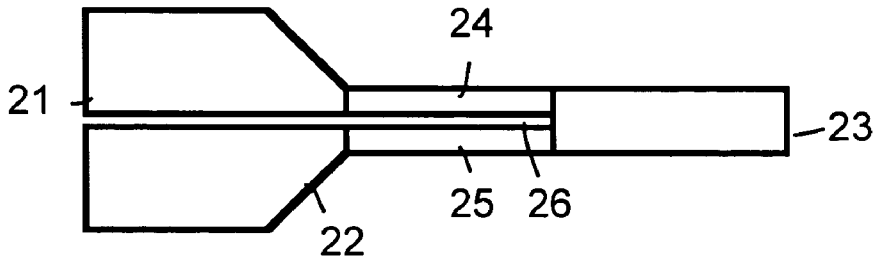
FIG. 2 shows a heating device in accordance with another embodiment of the present invention.

FIG. 2 shows a heater design where a ring resistor shape is used to provide heat. Current flows between a conductive lead 21 and a conductive lead 23 through a resistive region 24. Current flows between conductive lead 23 and a conductive lead 22 through a resistive region 25. An area 26 insulates resistive region 24 from resistive region 25. Area 26 also insulates conductive lead 21 from conductive lead 22. For example conductive lead region 21, conductive lead 22 and conductive lead 23 are composed of aluminum, or another metal or electrical conducting material. For example, resistive region 24 and resistive region 25 are composed of tantalum aluminum or another resistive material. The heater design shown in FIG. 2 is useful when it is desired, for example, to heat trench walls located above resistive region 24 and resistive region 25.

Figure 3:
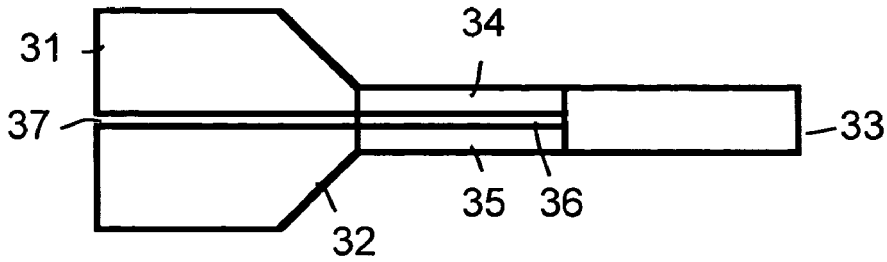
FIG. 3 shows a heating device in accordance with another embodiment of the present invention.

FIG. 3 shows a heater design where a ring resistor shape is used to provide heat. Current flows between a conductive lead 31 and a conductive lead 33 primarily through a resistive region 34. Current flows between conductive lead 32 and a conductive lead 33 primarily through a resistive region 35. A resistive region 36 has a substantially higher resistivity than resistive region 34 and resistive region 35. A region 37 insulates conductive lead 31 from conductive lead 32. For example conductive lead region 31, conductive lead 32 and conductive lead 33 are composed of aluminum, or another metal or electrical conducting material. For example, resistive region 34 and resistive region 35 are composed of tantalum aluminum or another resistive material. For example, resistive region 36 is composed of WSi3N4 or another material that has a higher resistivity than the resistivity of resistive region 34 and resistive region 35. The heater design shown in FIG. 3 is useful when it is desired, for example, to heat trench walls located above resistive region 34 and resistive region 35. The heater design shown in FIG. 3 is also useful for thermal inkjet ejection for drops created between resistive region 34 and 35.

Figure 4:
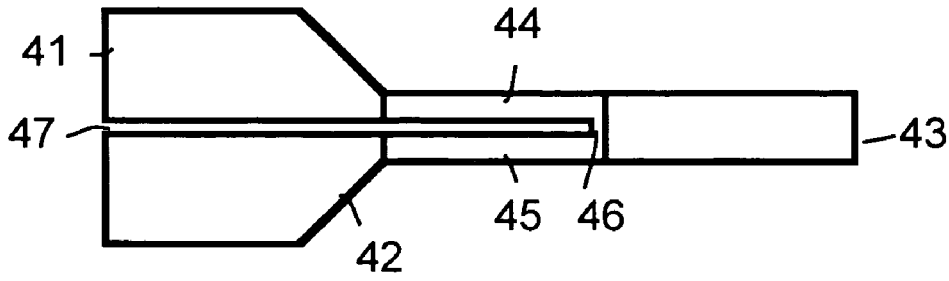
FIG. 4 shows a heating device in accordance with another embodiment of the present invention.

FIG. 4 shows a heater design where a ring resistor shape is used to provide heat. Current flows between a conductive lead 41 and a conductive lead 42 through a resistive region 44 and a resistive region 45. Only some current reaches a conductive lead 43 as current also flows through a resistive region 46 between resistive region 44 and resistive region 45. An area 47 insulates the remaining area of resistive region 44 from the remaining area of resistive region 45. Area 47 also insulates conductive lead 41 from conductive lead 42. For example, conductive lead region 41, conductive lead 42 and conductive lead 43 are composed of aluminum, or another metal or electrical conducting material. For example, resistive region 44, resistive region 45 and resistive region 46 are composed of tantalum aluminum or another resistive material. The heater design shown in FIG. 4 is useful when it is desired, for example, to heat trench walls located above resistive region 44 and resistive region 45. Resistive region 46 is superheated and is thus useful in, for example, initiating evaporation fluid in a consistent location (immediately adjacent to resistive region 46). One advantage of the design shown in FIG. 4 is that as resistive region 46 begins to fail and the amount of current through resistive region lessens, current can still pass between resistive region 44 and resistive region 45 through conductive lead 43.

Figure 5:
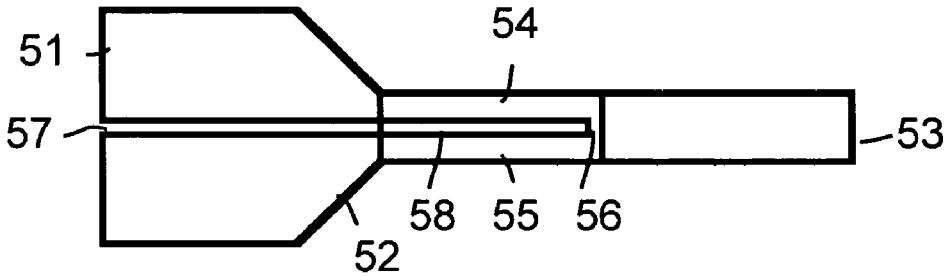
FIG. 5 shows a heating device in accordance with another embodiment of the present invention.

FIG. 5 shows a heater design where a ring resistor shape is used to provide heat. Current flows between a conductive lead 51 and a conductive lead 52 through a resistive region 54 and a resistive region 55. Only part of the current reaches a conductive lead 53 as current flows through a resistive region 56 between resistive region 54 and resistive region 55. A resistive region 58 has a substantially higher resistivity than resistive region 54 and resistive region 55. An area 57 insulates conductive lead 51 from conductive lead 52. For example conductive lead region 51, conductive lead 52 and conductive lead 53 are composed of aluminum, or another metal or electrical conducting material. For example, resistive region 54, resistive region 55 and resistive region 56 are composed of tantalum aluminum or another resistive material. For example, resistive region 58 is composed of WSi3N4 or another material that has a higher resistivity than the resistivity of resistive region 54 and resistive region 55. The heater design shown in FIG. 5 is useful when it is desired, for example, to heat trench walls located above resistive region 54 and resistive region 55. Resistive region 56 is superheated and is thus useful in, for example, initiating evaporation fluid in a consistent location (immediately adjacent to resistive region 56). One advantage of the design shown in FIG. 5 is that as resistive region 56 begins to fail and the amount of current through resistive region lessens, current can still pass between resistive region 54 and resistive region 55 through conductive lead 53 and to a lesser extent resistive region 56. The design shown in FIG. 5 also allows for the concentration of a central hot spot in region 56 from regions 54 and 55.

Figure 6:
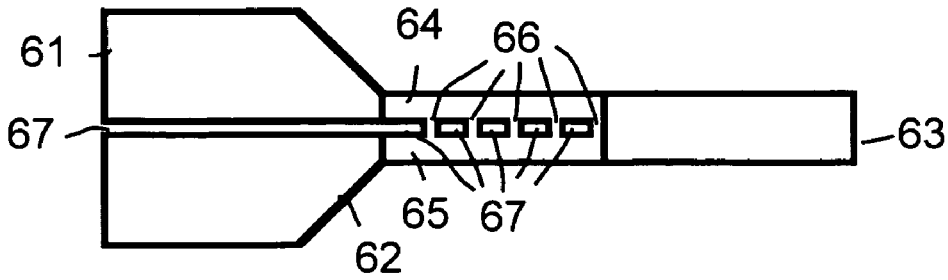
FIG. 6 shows a heating device in accordance with another embodiment of the present invention.

FIG. 6 shows a heater design where a ring resistor shape is used to provide heat. Current flows between a conductive lead 61 and a conductive lead 62 through a resistive region 64 and a resistive region 65. Only some current reaches a conductive lead 63 as current also flows through resistive regions 66 between resistive region 64 and resistive region 65. Areas 67 insulate the remaining area of resistive region 64 from the remaining area of resistive region 65. Areas 67 also insulate conductive lead 61 from conductive lead 62. For example, conductive lead 61, conductive lead 62 and conductive lead 63 are composed of aluminum, or another metal or electrical conducting material. For example, resistive region 64, resistive region 65 and resistive regions 66 are composed of tantalum aluminum or another resistive material. The heater design shown in FIG. 6 is useful when it is desired, for example, to heat trench walls located above resistive region 64 and resistive region 65. The resistive region 66 closest to conductive lead 61 and conductive lead 62 is superheated and thus useful in, for example, initiating evaporation fluid in a consistent location (immediately adjacent to resistive region 66). One advantage of the design shown in FIG. 6 is that as the resistive regions of resistive regions 66 that are closest to conductive lead 61 and conductive lead 62 fail the amount of current through these resistive regions lessen, the remaining resistive regions begin to conduct more current, extending the life of the heating device, with minimal changes in performance. When used in an inkjet printer, resistive regions can be spaced and shaped so that upon failure of any resistive regions, self calibration will occur allowing the printer to continue optimum operation.

Figure 7:
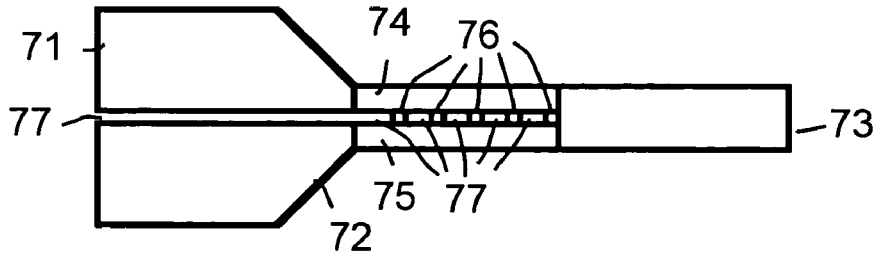
FIG. 7 shows a heating device in accordance with another embodiment of the present invention.

FIG. 7 shows a heater design where a ring resistor shape is used to provide heat. Current flows between a conductive lead 71 and a conductive lead 72 through a resistive region 74 and a resistive region 75. Only some current reaches a conductive lead 73 as current also flows through resistive regions 76 between resistive region 74 and resistive region 75. Areas 77 insulate the remaining area of resistive region 74 from the remaining area of resistive region 75. For example conductive lead region 71, conductive lead 72 and conductive lead 73 are composed of aluminum, or another metal or electrical conducting material. For example, resistive region 74 and resistive region 75 are composed of tantalum aluminum or another resistive material. For example, resistive regions 76 are composed of WSi3N4 or another material that has a higher resistivity than the resistivity of resistive region 74 and resistive region 75.

The heater design shown in FIG. 7 is useful when it is desired, for example, to heat trench walls located above resistive region 74 and resistive region 75. The resistive region or resistive regions 76 that is closest to conductive lead 71 and conductive lead 72 is heated and thus useful in, for example, initiating evaporation fluid in a consistent location (immediately adjacent to resistive region 76). One advantage of the design shown in FIG. 7 is that as the resistive regions of resistive regions 76 that are closest to conductive lead 71 and conductive lead 72 fail the amount of current through these resistive regions lessen, the remaining resistive regions begin to conduct more current, extending the life of the heating device, with minimal changes in performance. The higher resistivity of resistive regions 76, as compared to the resistivity of resistive regions 66 shown in FIG. 6, makes it possible to balance each resistive region of resistive regions 76 with approximately equal current flow and to have comparatively small voltage changes as resistive regions of resistive regions 76 fail. This is because resistivity of resistive regions 74 and 75 is significantly less than resistivity of resistive regions 76. In FIG. 6, by comparison, resistivity of resistive regions 64 and 65 is the same as the resistivity of resistive regions 66.

Figure 8:
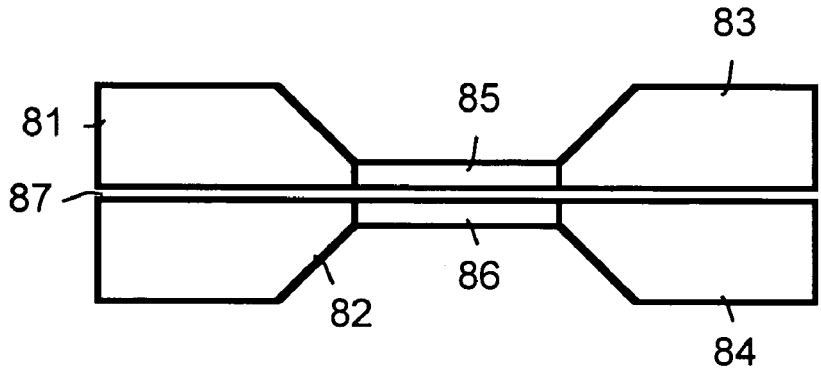
FIG. 8 shows a parallel resistor heating device in accordance with another embodiment of the present invention.

FIG. 8 shows a heater design where parallel resistors are used to provide heat. Current flows between a conductive lead 81 and a conductive lead 83 through a resistive region 85. Current flows between a conductive lead 82 and a conductive lead 84 through a resistive region 86. An area 87 insulates resistive region 85 from resistive region 86. Area 87 also insulates conductive lead 81 from conductive lead 82 and insulates conductive lead 83 from conductive lead 84. For example conductive lead region 81, conductive lead 82, conductive lead 83 and conductive lead 84 are composed of aluminum, or another metal or electrical conducting material. For example, resistive region 85 and resistive region 86 are composed of tantalum aluminum or another resistive material. The heater design shown in FIG. 8 is useful when it is desired, for example, to heat at, a faster rate, trench walls located above resistive region 85 and resistive region 86. The heater design shown in FIG. 8 is also useful in inkjet printers for ejecting drops between regions 85 and 86.

Figure 9:
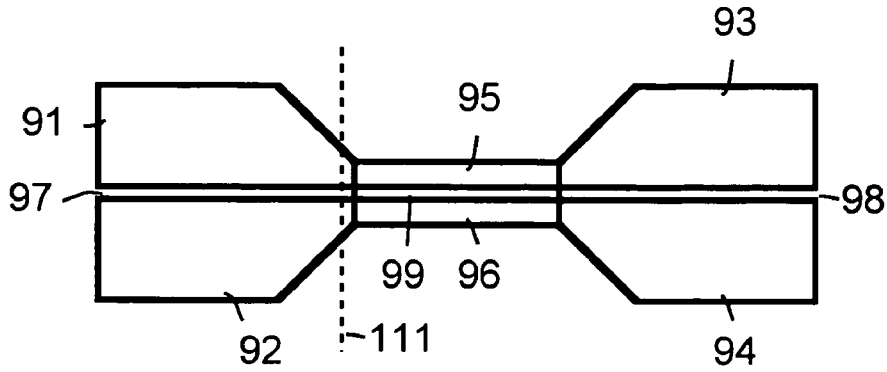
FIG. 9 shows a parallel resistor heating device in accordance with another embodiment of the present invention.

FIG. 9 shows a heater design where parallel resistors are used to provide heat. Current flows between a conductive lead 91 and a conductive lead 93 primarily through resistive material 95. Current flows between a conductive lead 92 and a conductive lead 94 primarily through resistive material 96. A portion of resistive material 99 exists between resistive material 95 and resistive material 96. An insulating region 97 exists between conductive lead 91 and conductive lead 92. An insulating region 98 exists between conductive lead 93 and conductive lead 94. For example conductive lead region 91, conductive lead 92, conductive lead 93 and conductive lead 94 are composed of aluminum, or another metal or electrical conducting material. For example, resistive material 95 and resistive material 96 are composed of tantalum aluminum or another resistive material. For example, resistive material 99 consists of WSi3N4 or another material that has a substantially higher resistivity than the resistivity of resistive material 95 and resistive material 96. The heater design shown in FIG. 9 is useful when it is desired, for example, to heat trench walls located above resistive region 95 and resistive region 96. The heater design shown in FIG. 9 is also useful in inkjet printers for ejecting drops between material 95 and 96.

Figure 11:
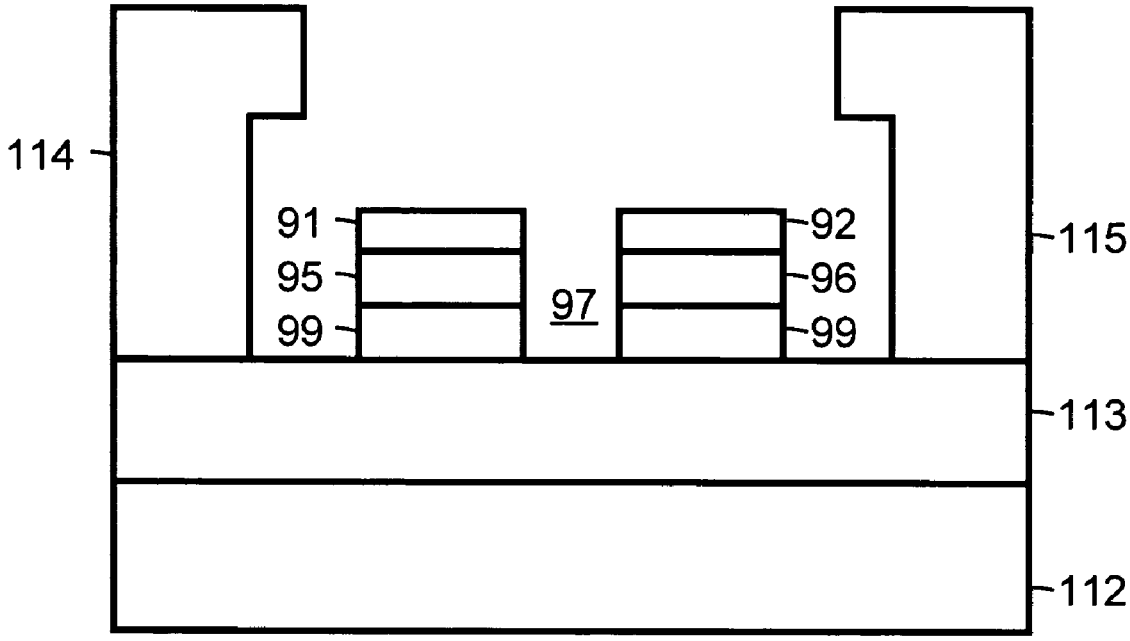
FIG. 11 shows a simplified cross-section of the heating device shown in FIG. 9 placed in an inkjet printhead in accordance with an embodiment of the present invention.

For example, FIG. 11 shows the heater design of FIG. 9 used in an inkjet printhead. A dashed line 111 shown in FIG. 9 is a cross section of the heater portion of the inkjet printhead displayed in FIG. 11. FIG. 11 shows a passivation layer 113 on top of base material 112. For example, passivation material 113 is composed of silicon dioxide (SiO2) and the base material 112 is composed of silicon. As shown in FIG. 11, resistive material 95 and resistive material 99 extend under conductive lead 91 at the cross section defined by dashed line 111. Likewise, resistive material 96 and resistive material 99 extend under conductive lead 92 at the cross section defined by dashed line 111 (shown in FIG. 9). A structure 114 and a structure 115 define the bore hole exit for the inkjet printhead.

Figure 12:
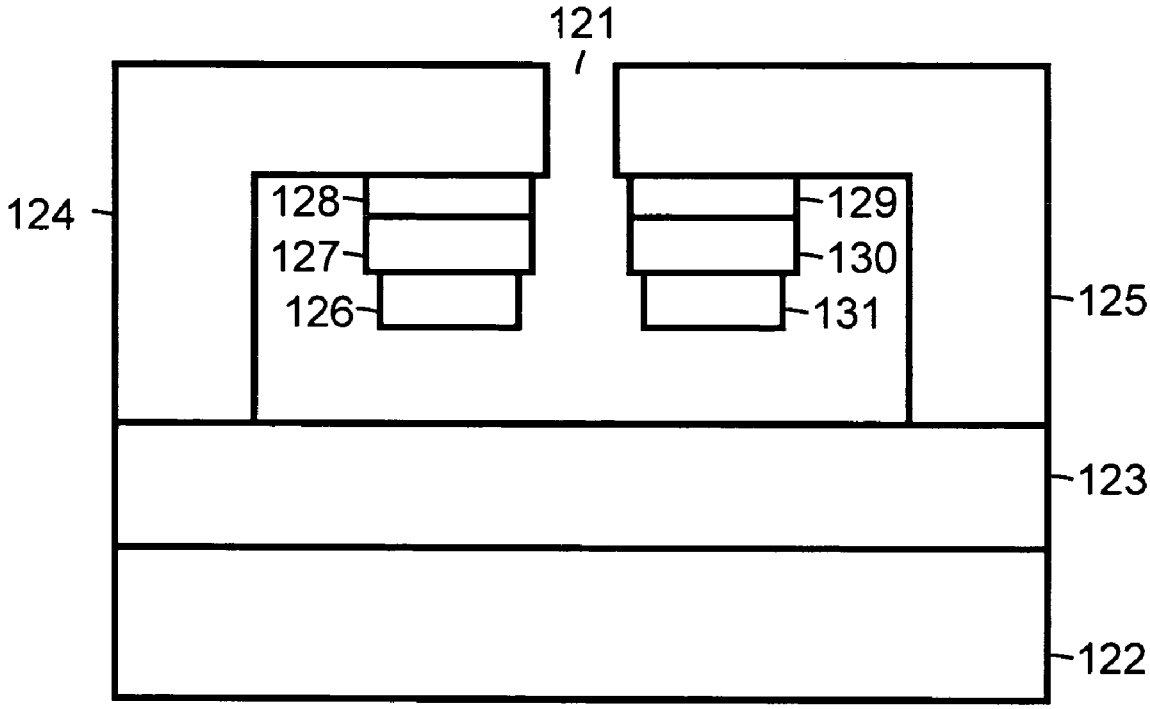
FIG. 12 shows a heating device placed in an inkjet printhead in accordance with another embodiment of the present invention.

FIG. 12 shows another example of a printhead where the resistor is inverted. FIG. 12 shows a passivation layer 123 on top of base material 122. For example, passivation material 123 is composed of silicon dioxide (SiO2) and the base material 122 is composed of silicon. A structure 124 and a structure 125 define a bore hole exit 121 for the inkjet printhead. A conductive lead region 126 and a conductive lead 131 are composed of aluminum, or another metal or electrical conducting material. Resistive material 127 and resistive material 130 are composed of tantalum aluminum or another resistive material. Resistive material 128 and resistive material 129 are composed of WSi3N4 or another material that has a substantially higher resistivity than the resistivity of resistive material 127 and resistive material 130.

Figure 13:
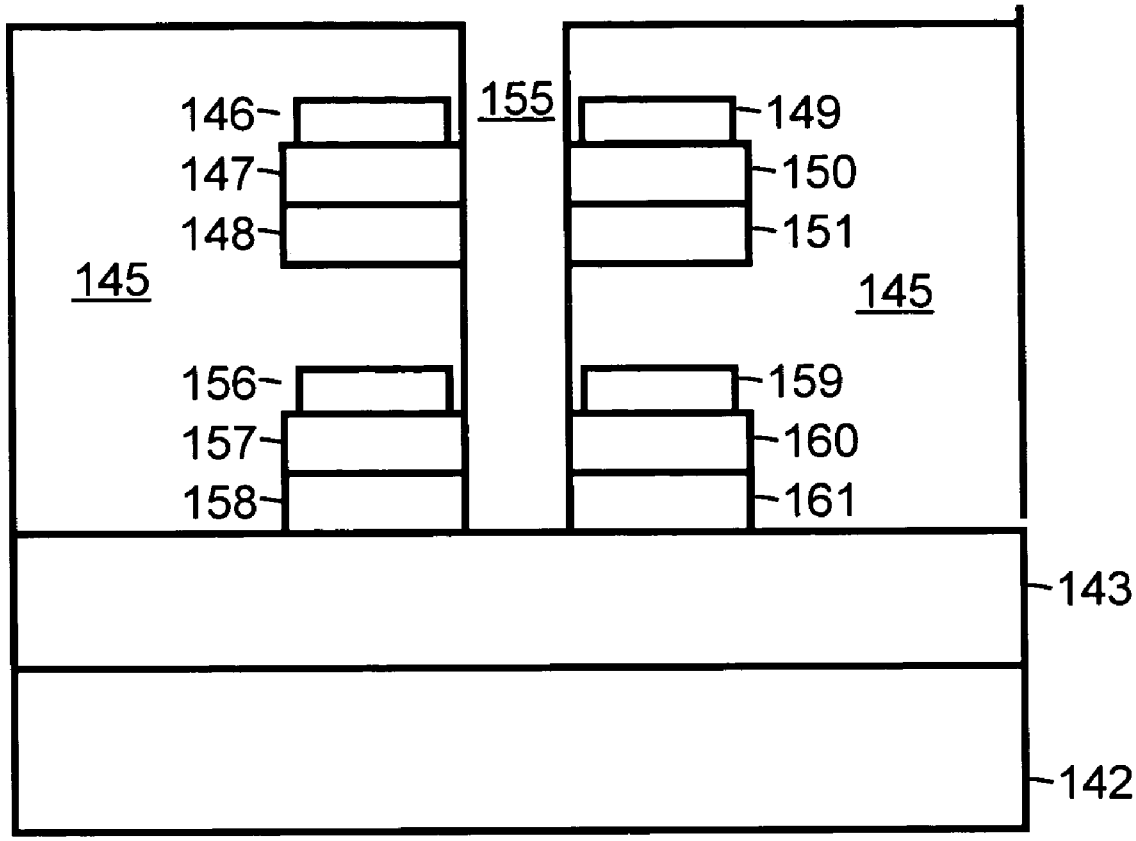
FIG. 13 shows a heating device placed in an inkjet printhead in accordance with another embodiment of the present invention.

FIG. 13 shows another example of a printhead where resistors are arranged in a tube design. FIG. 13 shows a passivation layer 143 on top of base material 142. For example passivation material 143 is composed of silicon dioxide (SiO2) and the base material 142 is composed of silicon. Structure 145 defines a bore hole exit 155 for the inkjet printhead. A conductive lead region 146 and a conductive lead 149 are composed of aluminum, or another metal or electrical conducting material. Resistive material 147 and resistive material 150 are composed of tantalum aluminum or another resistive material. Resistive material 148 and resistive material 151 are composed of WSi3N4 or another material that has a substantially higher resistivity than the resistivity of resistive material 147 and resistive material 150. Likewise, a conductive lead region 156 and a conductive lead 159 are composed of aluminum, or another metal or electrical conducting material. Resistive material 157 and resistive material 160 are composed of tantalum aluminum or another resistive material. Resistive material 158 and resistive material 161 are composed of WSi3N4 or another material that has a substantially higher resistivity than the resistivity of resistive material 157 and resistive material 160.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

I claim:

1. A heating device within an integrated circuit, comprising:

a first conductive lead;

a second conductive lead;

a third conductive lead;

a first resistive region connected between the first conductive lead and the third conductive lead; and, a second resistive region connected between the second conductive lead and the third conductive lead;

wherein a side formed by the first conductive lead and the first resistive region is parallel to a side formed by the second conductive lead and the second resistive region;

wherein an insulator is placed between the side formed by the first conductive lead and the first resistive region and the side formed by the second conductive lead and the second resistive region, except for at least one area directly between the first resistive region and the second resistive region, the at least one area including a third resistive region immediately adjacent to the third conductive lead, an entire first side of the third resistive region being in physical and electrical contact with the first resistive region and an entire second side of the third resistive region being in physical and electrical contact with the second resistive region.

2. A heating device as in claim 1:

wherein resistivity of the third resistive region is approximately equal to resistivity of the first resistive region and of the second resistive region.

3. A heating device as in claim 1:

wherein the at least one area includes a plurality of areas where third resistive regions separate the first resistive region and the second resistive region; and, wherein resistivity of the third resistive regions is approximately equal to resistivity of the first resistive region and of the second resistive region.

4. A heating device as in claim 1:

wherein the at least one area includes a plurality of areas where third resistive regions separate the first resistive region and the second resistive region; and, wherein resistivity of the third resistive regions is higher than resistivity of the first resistive region and of the second resistive region.

5. A heating device as in claim 1 wherein the integrated circuit is connected to a planar light circuit.

6. A heating device as in claim 1 wherein the integrated circuit is used within an inkjet printhead.

* * * * *